US005723020A

United States Patent [19]

Robinson et al.

[11] Patent Number: 5,723,020

[45] Date of Patent: Mar. 3, 1998

[54] FIRE-RETARDANT SATURATING KRAFT PAPER

[75] Inventors: Philip L. Robinson, Isle of Palms; Ramazan Benrashid, Mt. Pleasant, both of S.C.

[73] Assignee: Westvaco Corporation, New York, N.Y.

[21] Appl. No.: 742,636

[22] Filed: Nov. 1, 1996

Related U.S. Application Data

[63] Continuation-in-part of Ser. No. 527,931, Sep. 14, 1995, abandoned.

[51] Int. Cl.[6] ..... D21H 21/34

[52] U.S. Cl. ..... 162/159; 162/123; 162/135; 162/165; 162/181.2; 162/181.5; 428/531; 428/921

[58] Field of Search ..... 162/159, 165, 162/135, 123, 181.4, 181.5, 181.2, 181.1; 428/921, 531

[56] References Cited

U.S. PATENT DOCUMENTS

| | | | |
|---|---|---|---|
| 3,298,973 | 1/1967 | Quarles et al. . | |
| 3,519,476 | 7/1970 | Bremmer et al. . | |
| 3,740,358 | 6/1973 | Christie et al. . | |
| 3,903,337 | 9/1975 | Yamamoto et al. . | |
| 3,934,066 | 1/1976 | Murch . | |
| 4,032,393 | 6/1977 | Alfeis et al. . | |
| 4,038,451 | 7/1977 | Brown et al. . | |
| 4,130,458 | 12/1978 | Moore et al. | 162/159 |
| 4,184,969 | 1/1980 | Bhat . | |
| 4,404,250 | 9/1983 | Clarke . | |
| 5,156,775 | 10/1992 | Blount . | |
| 5,328,719 | 7/1994 | von Bonin . | |

FOREIGN PATENT DOCUMENTS

| | | |
|---|---|---|
| 1265636 | 2/1990 | Canada . |
| 901663 | 7/1962 | United Kingdom . |

*Primary Examiner*—Peter Chin
*Attorney, Agent, or Firm*—Daniel B. Reece IV; Terry B. McDaniel; Richard L. Schmalz

[57] ABSTRACT

The invention relates to an improvement in the art of making saturating kraft paper. In particular, the invention relates to a method for enhancing the fire-retardancy of saturating kraft paper containing alumina trihydrate and phenolic resin by including sodium borate into the paper. The improved saturating kraft is particularly useful in the production of fire-retardant high-pressure laminated materials.

13 Claims, No Drawings

FIRE-RETARDANT SATURATING KRAFT PAPER

This application is a continuation-in-part of the parent application Ser. No. 08/527,931 filed Sep. 14, 1995 now abandoned.

FIELD OF INVENTION

The invention relates to an improvement in the art of making saturating kraft paper. In particular, the invention relates to a method for enhancing the fire-retardancy of saturating kraft paper. The improved saturating kraft is particularly useful in the production of high-pressure laminated materials.

BACKGROUND OF THE INVENTION

Paper is a cellulosic web of crossing fibers which are more or less bonded to each other. Saturating kraft (a special type of absorbent paper designed to be impregnated with resin) is primarily used as the core stock for high-pressure laminates. High-pressure laminates, both decorative and industrial, are composite materials (i.e., tough cellulose fibers embedded in a matrix of brittle resin). The resulting laminate material possesses properties different and frequently better than either component. For example, such laminates possess considerably more flexibility than the cured resin and more water resistance than the fiber.

Saturating kraft is formed from a blend of hardwood pulp fibers and softwood (pine) pulp fibers, wherein the fibers are liberated from wood chips by means of the kraft pulping process. These pulps are subjected to low consistency (approximately 3%) refining prior to web formation.

To produce a high-pressure laminate, saturating kraft is first immersed in a bath of resin solution. Excess resin is subsequently removed from the surface of the web by squeeze rolls or scraper bars. The sheet is passed through an oven to evaporate the solvent in the resin to a level of 6–8% volatiles. The web is then cooled and either wound in rolls or sheeted to size. Resin-treated sheets are laid up to the desired number of plies and then consolidated under heat (ca. 300° F.) and pressure (ca. 1000 psi). During this operation the resin flows sufficiently to displace air between the plies. Simultaneously, the resin polymerizes into a rigid solid. The resulting finished composite is a monolithic structure.

To perform suitably in the laminating process the saturating kraft must possess a special combination of carefully controlled properties. First, the basis weight must be controlled within tight specifications. Not only must it be controlled across and throughout a roll, it must also be controlled on a quarter-inch to two-inch scale (a property generally referred to as formation).

Good saturating kraft sheets are also relatively clean (i.e., without sizeable shives or unfiberized pieces of wood). Such material constitutes non-uniformities in the structure causing surface roughness and points of stress concentration. This material is not readily impregnated with resin and thus can become the site of blister initiation.

The most important properties of saturating kraft are saturation and penetration. These two distinct physical processes occur simultaneously and consecutively, and are essential to the manufacture of satisfactory high-pressure laminates.

Saturation (which involves the pickup of resin by the porous structure of the cellulosic web) begins when the web enters the resin bath and ends when the scraper bars or other devices remove the excess resin. This process determines the ratio of resin to fiber in the final structure. In general, sufficient resin must be used so that all voids in the product are filled. As resin is more expensive than paper, economics dictate against the use of excess resin. Moreover, finished laminate properties begin to suffer if excessive quantities of resin are employed.

The saturation of the paper is controlled by the pore structure of the paper, the viscosity and surface tension of the resin, and the time required to travel from entering the resin bath to the scraper bars. In practice, the major control is the structure of the paper. This must be tailored to the rest of the operation so resin pickup will be at the desired value. Resin properties and speed are fine-tuning controls.

Once the proper amount of resin has been incorporated into the web, the next concern is achieving uniform and complete distribution of the resin throughout the web. This process, known as penetration, is also extremely dependent on the structure of the web. Capillary forces in the pores of the sheet act on the resin solution to redistribute the resin. Fine pores will steal resin from the large pores. The total amount of resin in the sheet becomes an important variable since this determines the quantity of resin to be shared by the various sized pores. In practice, an excess of resin is used to be sure there are no voids where the resin has not reached. As pointed out above, this excess is uneconomical and should be minimized.

Studies of the pore size distribution of paper used in high-pressure laminate manufacture indicate this is an important variable. The effects on saturation and penetration, however, are quite different. Saturation is a short time process (on the order of a second). It involves the time between applying the resin and the removal of the excess resin. During this short interval, most of the resin is picked up in the larger diameter pores (i.e., those 10 micrometers and above in diameter). The smaller ones are also picking up resin, but the dynamics favor the larger pores. To enhance saturation large pores are needed.

Penetration, on the other hand, is a longer term process which starts with the initial contact with the resin and probably does not come to a halt until the resin is completely polymerized in the press. During penetration, the smaller pores or capillaries are stealing resin from the larger pores. It is this process that spreads the resin from the surfaces that contact the resin to the interior of the sheet. Without good penetration, dry (white) centers are observed in the saturated sheet. These white areas are dry fibers which have not been wetted with resin. In general, penetration is enhanced by any process that increases the proportion of pore volume that exists in the smaller pores. This obviously tends to reduce saturation so, in practice, a balance must be maintained. As mentioned earlier, excess resin is used to ensure excellent penetration, otherwise voids occur which reduce strength and water resistance and which may become loci for blister formation.

The use of a fire-retardant saturating kraft as core stock is crucial to the production of an effectively fire-retardant laminate. However, the question of how to produce a practical fire-retardant saturating kraft paper—particularly while also maintaining the physical and mechanical properties necessary for the paper to be used in making fire-retardant high-pressure laminates—has remained a major problem for both saturating kraft and laminate producers.

A number of attempts have been made in the past to utilize boric acid and various borate compounds to impart flame resistance to laminates. For example, United Kingdom Patent No. 901,663 to Lowe et al. teaches reacting a neutralizing agent (orthoboric acid) with the free alkali in alkali-catalyzed resins to produce an inorganic salt (sodium borate) with some flame resistant properties. Likewise, U.S. Pat. No. 4,404,250 to Clarke claims the use of about 20% to 35% by weight of boric acid to produce a fire-retardant laminate. However, none of these methods proved to be commercially viable.

Currently, the preferred industry method for producing fire-retardant saturating kraft is to utilize alumina trihydrate (ATH) as a filler. Nevertheless, there are at least two major problems with this method. First, ATH is relatively expensive. Second, in order to achieve an effective level of fire-retardancy in the majority of high-pressure laminates it is necessary to utilize comparably large percentages of ATH (i.e., a minimum of about 45% by dry weight of the paper). FIREPLI® (a commercially available saturating kraft paper manufactured by Mead Incorporated) has been measured to contain about 48–50% ATH.

The problem with the utilization of ATH is that saturating kraft develops physical and mechanical problems (which render the paper unsuitable for use in the manufacture of high-pressure laminates) as an increasing percentage of the paper's cellulosic web is replaced by ATH. For example, saturating kraft loses mechanical strength as the ATH content increases. Furthermore, high-pressure laminates made with such a highly filled paper become increasingly brittle as the ATH content increases. Above a level of about 40% ATH (by dry paper weight) this brittleness can result in radial cracking in corresponding laminates. Moreover, the formation of the paper sheet itself is adversely affected as ATH loadings increase. This also degrades the physical and mechanical properties of corresponding laminates.

It is, therefore, an object of this invention to provide an improved method for producing fire-retardant saturating kraft paper.

A further objective of this invention is to provide a fire-retardant saturating kraft paper which maintains the mechanical and physical properties necessary for its use in producing fire-retardant high-pressure laminates.

Yet another objective of this invention is to provide an improved method for producing fire-retardant high-pressure laminates.

SUMMARY OF THE INVENTION

The objects of this invention are met by producing a novel saturating kraft which contains both alumina trihydrate (ATH) and borax (sodium borate). The synergistic effect achieved by this combination greatly enhances the fire-retardancy of saturating kraft without adversely affecting the physical and mechanical properties of the paper necessary for high-pressure laminate production.

DESCRIPTION OF THE PREFERRED EMBODIMENT

Thermal degradation of cellulose follows two primary pathways. One pathway (which predominates at temperatures below 250° C.) produces dehydrocellulose which, in turn, further decomposes into carbon, water, and carbon dioxide. This pathway is a rather slow process. The other pathway (which predominates when temperatures are above 250° C.) produces tar or levoglucosan which, in turn, further degrades into flammable gases. This reaction is extremely fast. The gases generated in the latter process have an effect on the thermal behavior of cellulose (as these gases incline to ignite, thereby generating more heat and advancing the spread of the flame). Any effort which disrupts this second pathway tends to both increase the thermal stability and decrease the flammability of cellulose.

Flame retardants can interfere with flame spread by functioning in either a gaseous phase or in a condensed solid phase. ATH imparts flame retardancy by functioning in both the gaseous and solid phases by endothermically releasing water over a temperature range of between about 220° C. to 450° C., thereby diluting the oxygen while also causing a cooling effect on the fire. The endothermic release of water provides a powerful heat sink which, coupled with the water vapors generated, serves to delay flame spread and heat generation.

In contrast, borax imparts flame retardancy by functioning in a condensed solid phase as a char producer (forming a protective layer to shield the cellulosic material from fire). Borax achieves this effect by reacting with the hydroxyl group of the number six cellulosic carbon to produce a borate ester. This ester is thermally more stable than levoglucosan because it does not degrade to volatile flammable materials. Moreover, such borates have a tendency to form a spongeous layer (or char) at the web's (or laminate's) surface that acts as an insulating and protecting layer. The mechanism of borax flame retardant combination involves conversion to sodium pentaborate at the temperature which cellulose begins to decompose. This endothermic reaction also interferes with the degradation of cellulose to smaller molecules (which are more susceptible to combustion and serve as fuel to feed the fire).

It has been found that a greater-than-additive fire retardancy is obtained in saturating kraft (as well as the laminates produced from the saturating kraft) by treating the paper with both ATH and borax. More importantly, this synergistic effect is achieved without adversely affecting the physical and mechanical properties of either the saturating kraft or the high-pressure laminates produced therefrom.

The present improved method for the production of flame-retardant saturating kraft paper employs an aqueous fluid containing cellulosic pulp, alumina trihydrate, and other papermaking ingredients to form an ATH-containing sheet of saturating kraft paper on a Fourdrinier wire cloth. The improvement in the method comprises applying to the surface of the sheet (after the dry line) an aqueous solution of water and borax in an amount sufficient to result in the saturating kraft paper retaining a certain level of borax.

The ATH content of saturating kraft suitable for use in the present invention is about 25% to about 40% by the dry weight of the paper. The preferred ATH content is in the range about 30% to about 35% by dry paper weight. The manner by which the ATH is loaded into the saturating kraft is not critical in that the ATH may be incorporated by any of the commonly known industry methods (see U.S. Pat. No. 4,032,393, which is hereby incorporated by reference).

The amounts of borax contained in saturating kraft which are suitable for use in the present invention are about 0.1% to about 4.0% by the dry weight of the paper. The preferred borax content is in the range about 1.0% to about 3.0% by dry paper weight.

The fact that borax is water-soluble prevents one from adding the borax to the wet end of the saturating kraft process. It is, therefore, necessary to apply borax in an aqueous solution to saturating kraft after the dry line of the paper. Suitable methods for applying the aqueous borax solution to the surface of the saturating kraft (after the web has been consolidated and partially dried) include using showers, size presses, and water boxes. The aqueous borax solution may be applied during the production of the saturating kraft paper or in a separate application to the produced paper. Size presses may be utilized if the aqueous borax solution is to be applied during the paper's drying cycle, while water boxes are used in conjunction with calendaring the paper. The preferred method of application is to use a shower while the paper is a consolidated web in the dryer section. It is further preferred to apply the aqueous borax solution via a fine spray or misting shower. Each application method covers the saturating kraft with the aqueous borax solution.

An improved method for producing flame-retardant high-pressure laminates can be practiced by resin-impregnating the improved flame-retardant saturating kraft paper. The preferred improved method for producing flame-retardant high-pressure laminates can be practiced by adding borax to the ATH-containing saturating kraft via means of the phenolic resin solution during the actual laminate production. In such cases the borax may be added either directly to the phenolic resin solution used to impregnate the ATH-containing saturating kraft sheets, or be dissolved in an appropriate solvent prior to addition to the phenolic resin solution (in order to control the viscosity of the solution). Solvents which are suitable for this purpose include, but are not limited to, the following: water, aliphatic alcohols, and combinations thereof.

Borax normally functions as a base. However, it has been found that adding borax to phenolic resins commonly used in producing laminates results in an unexpected drop in the pH of the resin formulation. For example, at a common borax loading of about 3% the pH of the resin formulation will drop from a range of about 8.0–9.0 to a range of about 3.0–3.5. It is believed that the added borax complexes with the phenolic resins to produce tetravalent borate anions which, in turn, liberate acidic hydronium ions.

While one may produce laminates utilizing acidic phenolic resin solutions, it is preferred to add an appropriate base (such as sodium hydroxide and the like) to adjust the pH of the resin solution back to its original range (usually 8.0–9.0 pH). Such neutralization dramatically increases the shelf life of the phenolic resin solution while also aiding in the curing of the laminates.

A number of production methods for manufacturing high-pressure laminates are well known in the industry. The improvement taught herein may be utilized with any laminate production method which utilizes saturated kraft paper.

The following examples are provided to further illustrate the present invention and are not to be construed as limiting the invention in any manner.

EXAMPLE 1

A series of saturating kraft sheets (185 lb.) containing varying levels of ATH were prepared using standard industry methods. A number of these sheets were subsequently dipped into a bath of 7.4% solids aqueous borax (sodium borate) solution to produce sheets containing about 2.8 wt. % (weight percent) borax.

Laminates were made for evaluation purposes from the different saturating kraft sheets via the following procedure. First, the paper was cut into a series of 1 foot by 1 foot squares. These paper squares were dipped into a bath of a standard laminating phenolic resin compound manufactured by Georgia-Pacific, Inc. for a time sufficient to permit resin saturation of the paper in the range of about 24–35% by weight of the paper (about one minute). Subsequently, the dipped squares were placed in an explosion proof oven at a temperature of about 150° C. for a time sufficient to attain a volatile (moisture) range of about 7% in the squares (about one minute).

Laminate sandwiches were made by placing a release sheet or square on the bottom, three of the above-treated squares in the middle, and a decorative layer of melamine resin-impregnated paper (manufactured by Mead, Inc.) on the top. Thermowells were inserted in the outer and middle plates in order to monitor temperatures.

The laminate sandwiches were subsequently placed into a hydraulic laminate press and subjected to about 1,200 pounds per square inch of pressure. The temperatures of the laminates were maintained in the range of 100°–280° F. over a period of about 45–60 minutes. At that time the heating was terminated and the laminates were allowed to cool before the pressure was released and the laminates removed from the press.

Three different tests were utilized to evaluate the fire-retardancy of the different laminates: 1) the burn test, 2) the UL-94 flame test, and 3) the limited oxygen index test. Laminates made with kraft containing no ATH or borax were employed as a control. An arbitrary good-bad ranking is reported along with the cumulative burn times for the laminates in Table I below.

In the burn test, fire-retardancies were evaluated by placing an ignited Bunsen burner directly under a vertically mounted laminate strip (2"×10") and allowing the laminate to burn for 30 seconds. The burner was then removed and the time required for the flame to go out was recorded as the burn time. The lower the burn time, the greater the fire-retardancy of the laminate.

Six such sample strips from a laminate are burned at each of two different flame temperatures (1700° F. and 2100° F.). These temperature were employed to give aggressive burns by which to better differentiate performance.

The UL-94 flame test, another procedure for measuring the flame spread on laminate samples, was performed by igniting five individual laminate strips with a Bunsen burner, and the length of time required for the flame to extinguish after the flame source has burn removed is recorded for each strip. Unlike the burn test, the flame from the burner is held under the laminate for 10 seconds at a time for two cycles. A rating is assigned to the sample according to the burn times. The V-0 rating (which is the best) is given when the sum of the two burns on the individual samples is less than or equal to 10 seconds and the sum of the two burns for all five samples is less than or equal to 50 seconds. The V-1 rating is given when the sum of the two burns for an individual sample is greater than 10 but less than 30 seconds, or if the cumulative burn times for the five samples in the two cycles is greater than 50 seconds but less than 250 seconds. Higher V-ratings are assigned for worse performance. The V-rating and cumulative burn times are listed for the laminates in Table I below.

The limited oxygen index test gives an indication of the minimum oxygen content needed to support combustion. As flammability decreases, more oxygen is needed to maintain a combustible fuel source. In this test, the oxygen content in a controlled atmosphere chamber around the sample is adjusted until combustion occurs. The minimum oxygen content that will support combustion is reported as the limited oxygen index (LOI) and is determined via the following equation:

$$LOI = \frac{\text{Volume } O_2}{\text{Volume } O_2 + \text{Volume } N_2} \times 100\%$$

Furthermore, the higher the oxygen content before combustion occurs, the more resistant the laminate is to burning. The values for the minimum oxygen content (%) that will support combustion, or oxygen index, are listed for the laminates in Table I below.

TABLE I

Fire-Retardancy Evaluations For Laminates Produced With Saturating Kraft Sheets Containing ATH and Borax

| Sheet Description | *Burn Test Rating and Burn Times 1700° F. (sec.) | 2100° F. (sec.) | UL-94 Flame Test V-Rating (sec.) | Limited Oxygen Index (% $O_2$) |
|---|---|---|---|---|
| 0% ATH & 0% Borax | very bad (87) | very bad (90) | V-1 (143) | 33 |
| 36.4% ATH & 0% Borax | excellent (2) | very good (3) | V-0 (17) | 41 |
| 35.5% ATH & 2.8% Borax | excellent (0) | excellent (2) | V-0 (0) | 43 |

*Burn Test (1700° F.): 0–2 excellent; 3–5 very good; 6–9 good; 10–15 medium; 16–20 bad; >20 very bad
*Burn Test (2100° F.): 0–5 excellent; 6–10 very good; 11–15 good; 16–20 medium; 21–25 bad; >20 very bad The data in Table I shows that in saturating kraft the combination of ATH and borax functions in a synergistic manner to achieve greater-than-expected results, thereby producing high-pressure laminates with consistently low burn times and high oxygen indices. Moreover, the fire-retardant laminates made from saturating kraft containing the combination of both ATH and borax did not exhibit any of the physical or mechanical problems associated with high percentage loading of ATH.

EXAMPLE 2

A series of saturating kraft sheets (185 lb.) containing varying levels of ATH were prepared using standard industry methods. Laminates were made for evaluation purposes from the different saturating kraft sheets via the following procedure. First, the paper was cut into a series of 1 foot by 1 foot squares. These paper squares were dipped into a bath containing a mixture of a standard laminating phenolic resin compound manufactured by Georgia-Pacific, Inc. and varying levels of borax for a time sufficient to permit resin saturation of the paper in the range of about 24–35% by weight of the paper (about one minute). Subsequently, the dipped squares were placed in an explosion proof oven at a temperature of about 150° C. for a time sufficient to attain a volatile (moisture) range of about 7% in the squares (about one minute).

Laminate sandwiches were made by placing a release sheet or square on the bottom, three of the above-treated squares in the middle, and a decorative layer of melamine resin-impregnated paper (manufactured by Mead, Inc.) on the top. Thermowells were inserted in the outer and middle plates in order to monitor temperatures.

The laminate sandwiches were subsequently placed into a hydraulic laminate press and subjected to about 1,200 pounds per square inch of pressure. The temperatures of the laminates were maintained in the range of 100°–280° F. over a period of about 45–60 minutes. At that time the heating was terminated and the laminates were allowed to cool before the pressure was released and the laminates removed from the press.

The UL-94 flame test described in Example 1 above was employed at two different temperatures to evaluate the fire-retardancy of the different laminates. The results are listed in Table II and Table III below.

TABLE II

UL-Quick Test Burn Times (1700° F.) for Laminates Treated with Resin Containing Varying Loadings of Borax

| ATH (%) | Borax (%) | Burn Times In Seconds |
|---|---|---|
| | 1700° F. Burn Temperature | |
| 0 | 0 | 19, 8, 30, 5, 15, 15 = 92 |
| 0 | 1 | 2, 6, 6, 19, 7, 4 = 44 |
| 0 | 3 | 0, 5, 3, 2, 6, 9 = 25 |
| 26 | 1 | 1, 0, 3, 0, 7, 3 = 14 |
| 26 | 3 | 0, 1, 0, 3, 3, 0 = 7 |
| 32 | 1 | 0, 1, 2, 1, 0, 2 = 6 |
| 32 | 3 | 0, 0, 0, 0, 1, 0 = 1 |
| 36 | 0 | 0, 0, 3, 2, 1, 5 = 11 |
| 36 | 1 | 0, 0, 2, 0, 0, 0 = 2 |
| 36 | 3 | 0, 2, 0, 1, 0, 0 = 3 |

TABLE III

UL-Quick Test Burn Times (2100° F.) for Laminates Treated with Resin Containing Varying Loadings of Borax

| ATH (%) | Borax (%) | Burn Times In Seconds |
|---|---|---|
| | 1700° F. Burn Temperature | |
| 0 | 0 | 9, 4, 20, 6, 13, 9 = 61 |
| 0 | 1 | 7, 2, 9, 5, 5, 11 = 39 |
| 0 | 3 | 0, 2, 3, 1, 11, 6 = 23 |
| 26 | 1 | 1, 1, 3, 1, 1, 1 = 8 |
| 26 | 3 | 2, 1, 1, 0, 0, 3 = 6 |
| 32 | 1 | 0, 1, 0, 0, 2, 3 = 6 |
| 32 | 3 | 1, 1, 0, 0, 1, 1 = 4 |
| 36 | 0 | 2, 2, 1, 6, 2, 4 = 17 |
| 36 | 1 | 0, 2, 1, 2, 3, 1 = 9 |
| 36 | 3 | 0, 2, 0, 1, 1, 2 = 6 |

The results in Tables II and III show that the combination of ATH and borax in saturating kraft greatly improve laminate burn performance, especially when compared to laminates made from saturating kraft containing ATH alone. Moreover, the fire-retardant laminates made from saturating kraft containing the combination of both ATH and borax did not exhibit any of the physical or mechanical problems associated with high percentage loading of ATH.

EXAMPLE 3

A series of saturating kraft sheets (185 lb.) containing varying levels of ATH were prepared using standard industry methods. Laminates were made for evaluation purposes from the different saturating kraft sheets via the following procedure. First, the paper was cut into a series of 1 foot by 1 foot squares. A bath was prepared containing a mixture of a standard laminating phenolic resin compound manufactured by Georgia-Pacific, Inc. and varying levels of borax into which sufficient amounts of sodium hydroxide was added to adjust the pH of the mixture into the range of about 8.0 to 9.0. The paper squares were dipped into the bath mixture for a time sufficient to permit resin saturation of the paper in the range of about 24–35% by weight of the paper (about one minute). Subsequently, the dipped squares were placed in an explosion proof oven at a temperature of about 150° C. for a time sufficient to attain a volatile (moisture) range of about 7% in the squares (about one minute).

Laminate sandwiches were made by placing a release sheet or square on the bottom, three of the above-treated squares in the middle, and a decorative layer of melamine resin-impregnated paper (manufactured by Mead, Inc.) on the top. Thermowells were inserted in the outer and middle plates in order to monitor temperatures.

The laminate sandwiches were subsequently placed into a hydraulic laminate press and subjected to about 1,200 pounds per square inch of pressure. The temperatures of the laminates were maintained in the range of 100°–280° F. over a period of about 45–60 minutes. At that time the heating was terminated and the laminates were allowed to cool before the pressure was released and the laminates removed from the press.

The UL-94 flame test described in Example 1 above was employed at two different temperatures to evaluate the fire-retardency of the different laminates. The results are listed in Table IV below.

TABLE IV

Laminate Burn Results with pH-Adjusted Resin Containing Borax

| ATH (%) | Borax (%) | Burn Temperature (°F.) | Burn Times |
|---|---|---|---|
| no ATH | no borax | 1700° | 13, 2, 4, 26, 4, 16 = 65 |
| | | 2100° | 5, 28, 5, 1, 34, 23 = 96 |
| no ATH | 3% borax | 1700° | 1, 5, 0, 0, 5, 15 = 26 |
| | | 2100° | 8, 4, 16, 1, 14, 8 = 51 |
| 30% ATH | no borax | 1700° | 1, 3, 1, 0, 0, 0 = 5 |
| | | 2100° | 2, 14, 1, 13, 7, 7 = 5 |
| 30% ATH | 3% borax | 1700° | 0, 0, 1, 0, 0, 0 = 1 |
| | | 2100° | 0, 0, 1, 2, 1, 1 = 5 |
| 35% ATH | no borax | 1700° | 0, 3, 0, 0, 0, 7 = 10 |
| | | 2100° | 7, 3, 1, 0, 8, 0 = 19 |
| 35% ATH | 3% borax | 1700° | 0, 0, 0, 0, 1, 0 = 1 |
| | | 2100° | 0, 1, 0, 5, 0, 3 = 9 |

The results in Table IV show that the combination of ATH and borax in saturating kraft functions in a synergistic manner to greatly improve laminate burn performance, especially when compared to laminates made from saturating kraft containing either ATH or borax alone.

Testing found that it is virtually impossible to load by resin addition the 10% borax content necessary to give substantial improvements in laminate burn performance where borax alone is added to the saturating kraft. This is because large volumes of solvent are required to solubilize the borax with the resin. The solvent dilutes the resin, making proper saturation of the sheet difficult.

Many modifications and variations of the present invention will be apparent to one of ordinary skill in the art in light of the above teaching. It is understood therefore that the scope of the invention is not to be limited by the foregoing description but rather is to be defined by the claims appended hereto.

What is claimed is:

1. An improved method for the production of a flame-retardant high-pressure phenolic resin-impregnated kraft paper laminate, wherein the improvement comprises impregnating saturating kraft paper, said paper containing alumina trihydrate in an amount from about 25% to about 40% by the dry weight of the paper, with a mixture consisting essentially of phenolic resin and sodium borate in an amount sufficient to result in the laminate retaining a) an amount of phenolic resin sufficient to fill voids of said kraft paper; and b) sodium borate in an amount from about 0.1% to about 4.0% by the dry weight of the laminate, and applying pressure to the mixture-impregnated paper to form the laminate.

2. The method of claim 1 wherein the saturating kraft paper contains alumina trihydrate in an amount from about 30% to about 35% by the dry weight of the paper.

3. The method of claim 1 wherein the flame-retardant high-pressure laminate contains sodium borate in an amount from about 1% to about 3% by the dry weight of the laminate.

4. The method of claim 1 wherein, prior to the addition of the sodium borate to the mixture, the sodium borate is dissolved in a member selected from the group consisting of water, aliphatic alcohols, and combinations thereof.

5. The method of claim 1 wherein a sufficient amount of base is added to the mixture to result in the mixture having a pH in the range of 8.0 to 9.0.

6. The flame-retardant high-pressure laminate of claim 1.

7. The method of claim 1 wherein the amount of phenolic resin impregnating the saturating kraft paper is in the range of about 24% to about 35% by weight of the saturating kraft paper.

8. An improved method for the production of a flame-retardant high-pressure phenolic resin-impregnated kraft paper laminate, wherein the improvement comprises 1) impregnating, with an amount of phenolic resin sufficient to fill voids of said kraft paper, saturating kraft paper containing alumina trihydrate in an amount from about 25% to about 40% by the dry weight of the paper, said paper being formed by a) applying an aqueous fluid containing cellulosic pulp, alumina trihydrate, and other papermaking ingredients onto a Fourdrinier wire cloth to form a sheet, then b) applying to the surface of the sheet, after the dry line of the paper, an aqueous solution consisting essentially of water and sodium borate in an amount sufficient to result in the paper retaining sodium borate in an amount from about 0.1% to about 4.0% by the dry weight of the paper; and 2) applying pressure to the resin-impregnated saturating kraft paper to form the laminate.

9. The method of claim 8 wherein the mount of phenolic resin impregnating the saturating kraft paper is in the range of about 24% to about 35% by weight of the saturating kraft paper.

10. The method of claim 8 wherein the saturating kraft paper contains alumina trihydrate in an amount from about 30% to about 35% by the dry weight of the paper.

11. The method of claim 8 wherein the saturating kraft paper contains sodium borate in an amount from about 1% to about 3% by the dry weight of the paper.

12. The method of claim 8 wherein the aqueous solution is applied by means selected from the group consisting of size presses, water boxes, and showers.

13. The flame-retardant high-pressure laminate of claim 8.

* * * * *

UNITED STATES PATENT AND TRADEMARK OFFICE

CERTIFICATE OF CORRECTION

PATENT NO. : 5,723,020
DATED : March 3, 1998
INVENTOR(S) : Philip L. Robinson and Ramazan Benrashid It is certified that error appears in the above-identified patent and that said Letters Patent is hereby corrected as shown below:

In column 6, line 45, delete "bum" and substitute therefor --burn--.

In Table III, line 52, delete "1700°" and substitute therefor --2100°--.

In column 10, line 64, claim 9, delete "mount" and substitute therefor --amount--.

Signed and Sealed this

Fifth Day of May, 1998

Bruce Lehman

*Attest:*

BRUCE LEHMAN

*Attesting Officer*

*Commissioner of Patents and Trademarks*